US006709297B2

(12) United States Patent
Lee

(10) Patent No.: US 6,709,297 B2
(45) Date of Patent: Mar. 23, 2004

(54) MULTI DIRECTIONAL SWIVELING OUTLET ADAPTOR

(76) Inventor: Dominic Lee, Apt. 1C, Duke Garden, #2 Duke Street, Kowloon, Hong Kong (CN)

( * ) Notice: Subject to any disclaimer, the term of this patent is extended or adjusted under 35 U.S.C. 154(b) by 0 days.

(21) Appl. No.: 10/105,025

(22) Filed: Mar. 22, 2002

(65) Prior Publication Data

US 2003/0181105 A1 Sep. 25, 2003

(51) Int. Cl.[7] ..... H01R 25/00
(52) U.S. Cl. ..... 439/638; 439/490
(58) Field of Search ..... 439/11, 13, 25, 439/131, 638, 628, 490

(56) References Cited

U.S. PATENT DOCUMENTS 4,659,161 A * 4/1987 Holcomb ..... 439/490
4,875,152 A * 10/1989 Foster ..... 363/146
5,829,993 A * 11/1998 Wu ..... 439/131
5,888,105 A 3/1999 Brown et al.
5,906,517 A 5/1999 Crane et al.
5,957,701 A * 9/1999 McMillin ..... 439/13
6,118,643 A * 9/2000 Dyer et al. ..... 361/111
6,315,617 B1 11/2001 Al-Sabah
6,336,825 B1 * 1/2002 Seefried ..... 439/488

* cited by examiner

*Primary Examiner*—T. C. Patel
(74) *Attorney, Agent, or Firm*—Aufrichtig Stein & Aufrichtig, P.C.; Peter D. Aufrichtig

(57) ABSTRACT

A multi directional swiveling outlet adaptor which includes a plug assembly for connecting to a power source, a multiple outlet module rotatably coupled to the plug assembly so that an electrical connection is maintained as the plug assembly is rotated relative to the outlet module and a light assembly coupled to the outlet module for providing a visual indication that the plug is connected to a power source. The swivel outlet adaptor has three orthogonally oriented outlet adaptors designed to reduce the potential for tangling of power cords and maintains a low profile equivalent to the thickness of a plug.

6 Claims, 4 Drawing Sheets

MULTI DIRECTIONAL SWIVELING OUTLET ADAPTOR

BACKGROUND OF THE INVENTION

The invention is generally directed to a multiple outlet adaptor and, in particular, to a swiveling three outlet adaptor which includes a light which identifies when the outlet adaptor is plugged into a live outlet visible from both sides.

In the past there have been many outlet adaptors which are fixed and provide the ability to plug multiple electronic devices into a single wall outlet. Generally, these multiple outlet adaptors stick straight out from the socket into which they are plugged and occupy significant space. Particularly when they are to be used on walls which have furniture, there is a need to provide for the ability to swivel an adaptor so that it can occupy less space. Currently, there are swivel tabs which usually include multiple outlets on one surface of the swivel tab and the surface can generally swivel along one axis so that the outlets can either face upward, outward or downward. However, there is a need for a particularly low profile swivel adaptor which is narrower against the wall outlet to allow the furniture to be placed closer to the wall without interfering with the connection of electronic devices to the swivel outlet adaptor. There is also a need for the outlet adaptor to have outlets in different directions to allow easier access from different angles and to include a light which is visible whether the swivel adaptor is rotated upwards or downwards, exposing opposite sides of the swivel tab adaptor.

SUMMARY OF THE INVENTION

The invention is generally directed to a thin profile three outlet swivel adaptor with lights on both sides which is able to swivel 180 degrees and includes outlets in three directions, thereby providing easier access to the connectors from different angles. The three separate connector outlets provide for wires of the electrical devices to come out of three different directions, thereby enhancing the neatness of the wires and avoiding tangling of the wires. As a result of the swivel nature of the outlet adaptor, two three-outlet swivel adaptors can be plugged into a single standard, two-outlet wall socket without problems.

The invention is also directed to a very low profile (about 1 inch clearance only) outlet adaptor which allows furniture to be placed much more closely to the wall and has lights visible from both sides to show if power is present at the outlets.

It is an object of the invention to provide an improved swivel outlet adaptor.

Another object of the invention is to provide an improved swivel outlet adaptor which includes a light showing power flowing into the outlets, whether the swivel outlet adaptor is swivelled in one direction or the opposite direction.

Yet another object of the invention is to provide an improved swivel outlet adaptor which separates the outlets in a fashion which enhances the tangle-free connection of multiple electrical devices to the swivel outlet adaptor.

Still another object of the invention is to provide an improved lighted swivel outlet adaptor which provides a continuous reliable electrical connection as the outlet adaptor is swivelled about its axis of rotation.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
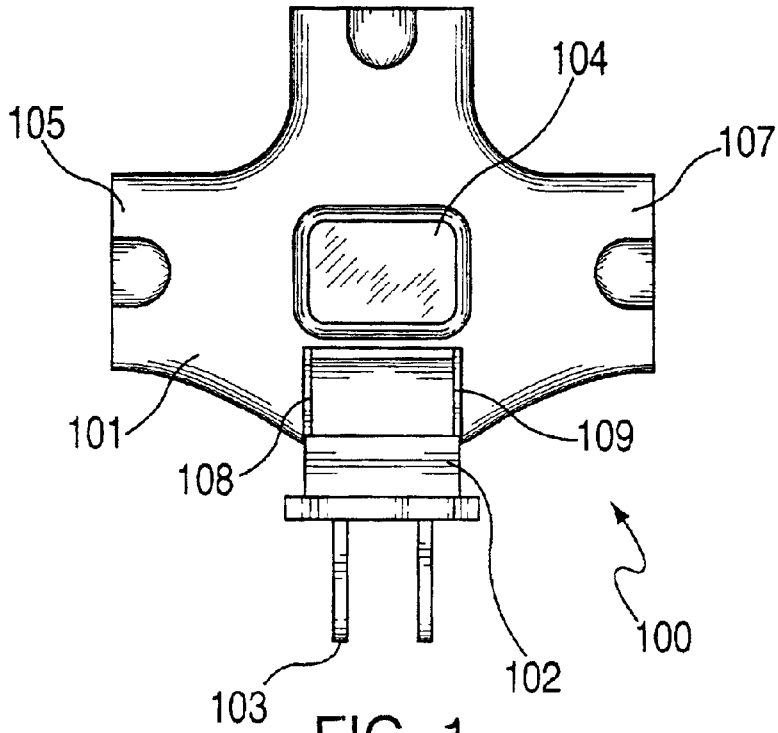
FIG. 1 is a top elevational view of multi directional swiveling outlet adaptor constructed in accordance with a preferred embodiment of the invention.
Figure 2:
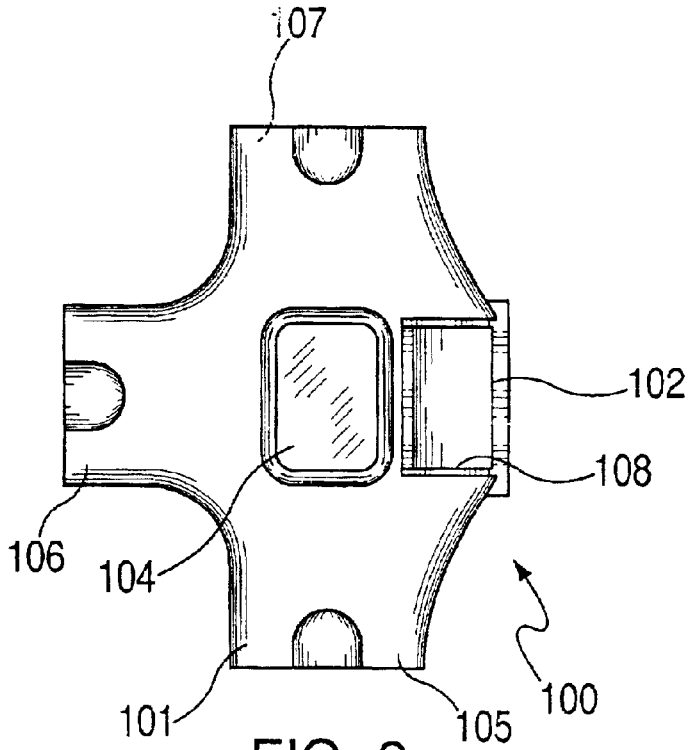
FIG. 2 is a top elevational view similar to FIG. 1 in which the plug is rotated relative to the body of the multi directional swiveling outlet adaptor.

Reference is first made to FIGS. 1–5 wherein a multi directional swiveling outlet adaptor 100, constructed in accordance with a preferred embodiment of the invention is depicted. Adaptor 100 includes a main body 101 and a swiveling plug section 102 with plugs 103. Main body 101 includes three connecting adaptors 105, 106 and 107, which are oriented 90 degrees from each other and adaptors 105, 107 are also 90 degrees from plug 102 in its flat state, as shown in FIG. 1. Adaptor 106 is 180 degrees separated from plug 102. When plug 103 is rotated, as seen in FIG. 2, so that the plugs 103 are perpendicular to the plane of main section 101 as rotating members 108 and 109 interact to allow plug section 102 to rotate relative to main section 101, there is still the same orthogonal relation between adaptors 105, 106 and 107.

Figure 3:
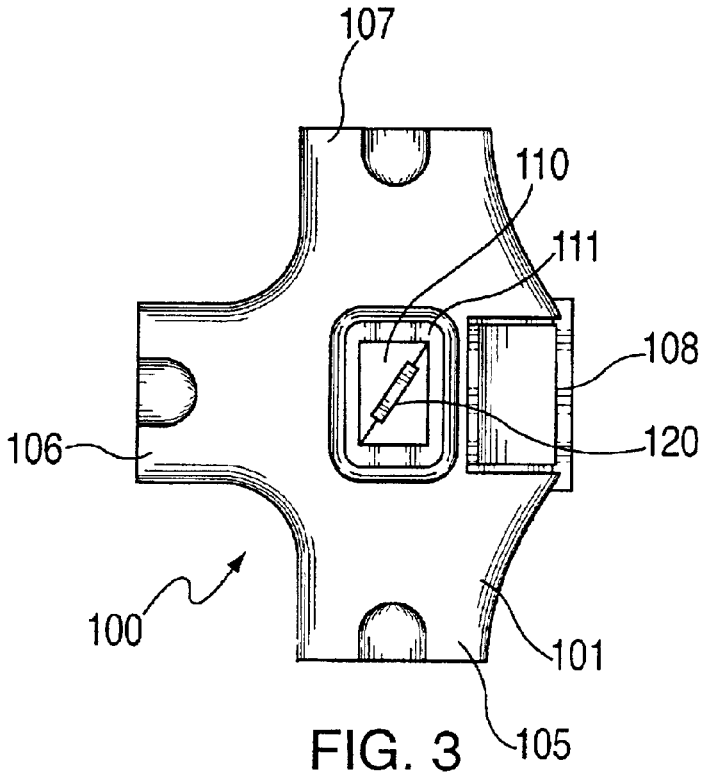
FIG. 3 is a top elevational view similar to the view of FIG. 2 in which the light cover is removed.

Window 104, shown in FIGS. 1 and 2, is present on both sides of main body 101 adjacent to rotating members 108 and centrally located to adaptors 105, 106 and 107. These sides or surfaces on the top and bottom of main body 101 containing windows 104 are generally parallel to each other. The lighting device, a light-emitting diode 120, as best seen in FIG. 3, is centrally located in the center of body 101 inside opening 110 and proximate support member 111. Light-emitting diode 120 includes wires which are used for connecting to an electrical circuit in conventional fashion to indicate that plugs 103 are connected into a power source and that current is flowing. Only a very small amount of current is used through light-emitting diode 120. Other low-current lighting applications may be similarly utilized in place of light-emitting diode 120.

Figure 4:
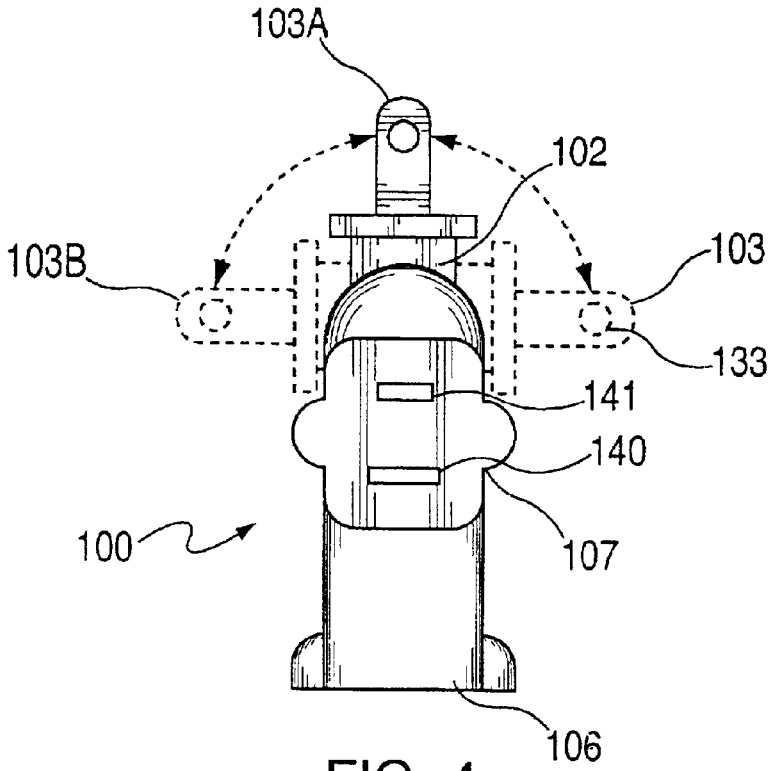
FIG. 4 is a side elevational view of the multi directional swiveling outlet adaptor of FIG. 1, showing the swivelling feature.

As seen in FIG. 4, plug member 102 rotates through a 180 degree arc from the position shown as 103 through the position 103A to position 103B. As see in FIG. 4, plug 107 includes two polarized slots 140, 141. Depending upon the country in which the adaptor is to be used or the voltage, the actual slots or other connecting elements on adaptor 100 can be varied without affecting the operation of the device.

Figure 5:
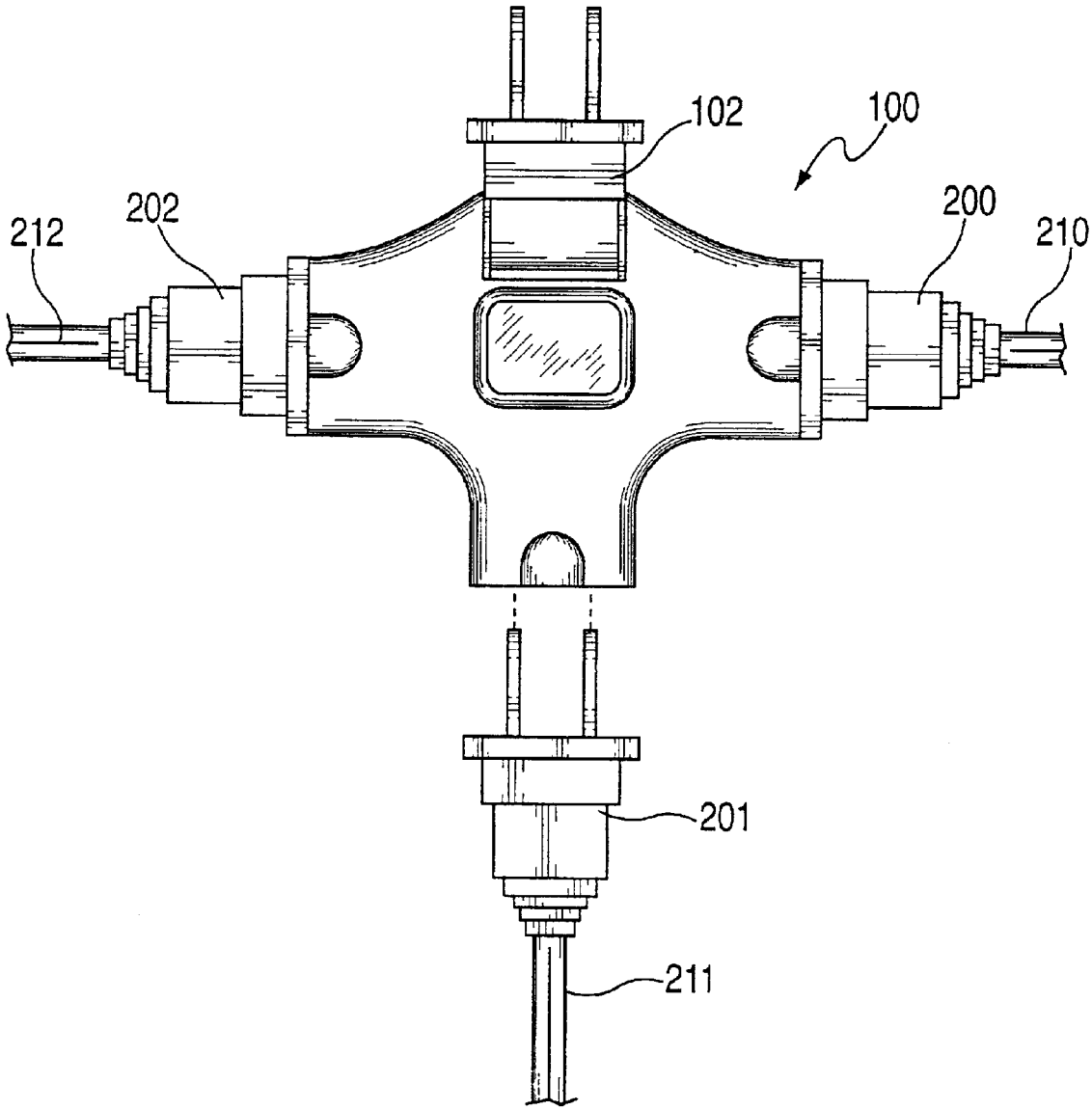
FIG. 5 is a top elevational view of a multi directional swiveling outlet adaptor showing the way in which power cords are connected to the adaptor.
Figure 7:
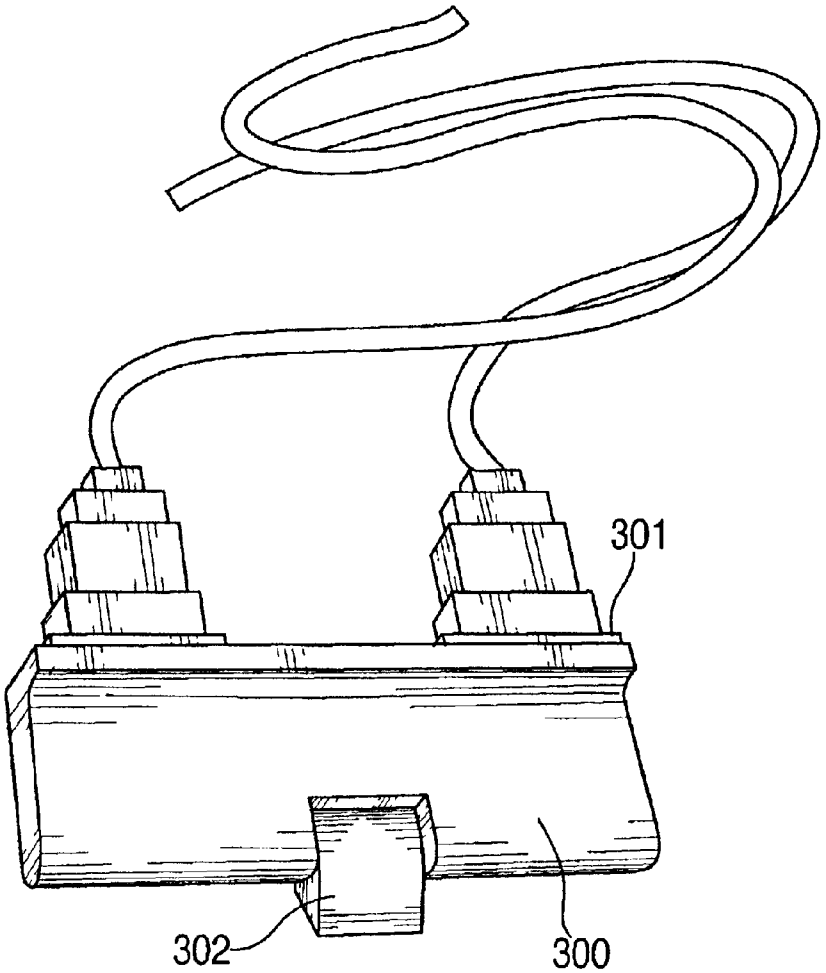
FIG. 7 (PRIOR ART)
FIG. 7 is a front elevational view of a prior art swiveling outlet adaptor.

FIG. 5 shows the way in which cords 210, 211 and 212 with plugs 200, 201 and 202 can be connected to adaptor 100. As seen in FIG. 5, the cords for the different devices are positioned in a fashion so that they are unlikely to get tangled. This is contrasted with the prior art construction, generally indicated as 300, shown in FIG. 7, in which the multiple plugs are on the same surface of adaptor 300 such that the cords can easily become tangled.

Figure 6:
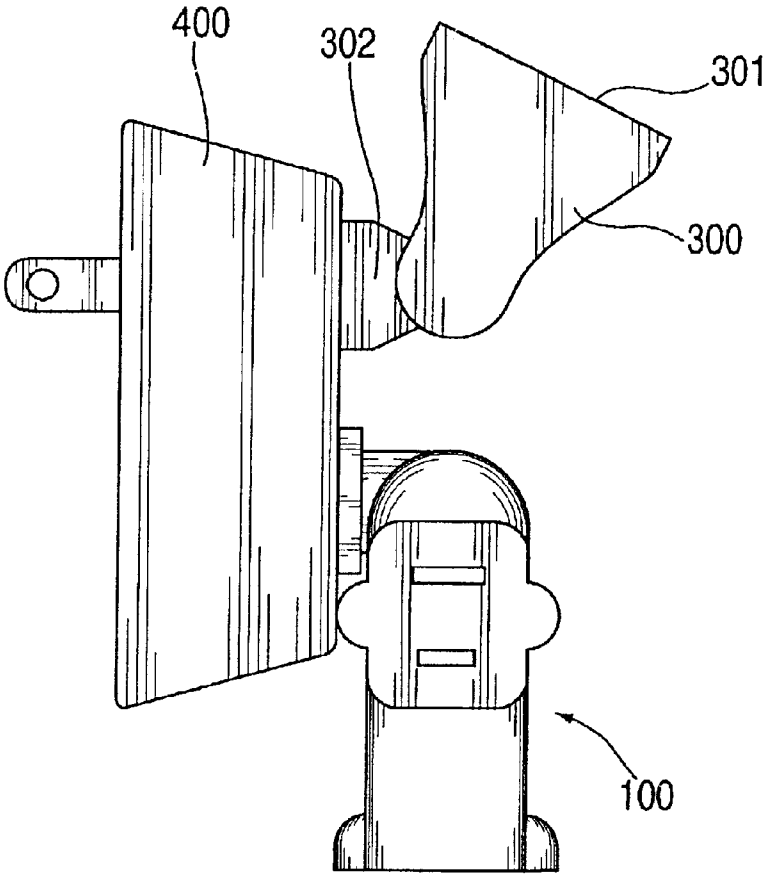
FIG. 6 is a side elevational view of the multi directional swiveling outlet adaptor of FIG. 1 and a prior art swiveling outlet adaptor.

Reference is also made to FIG. 6 wherein a multi directional swiveling outlet adaptor 100 constructed in accordance with a preferred embodiment of the invention is plugged into an outlet, as is a prior art swiveling adaptor 300. Prior art swiveling adaptor 300 includes three adaptors 301 on a single face of the adaptor and a plug 302 which is plugged into the outlet 400. As seen in FIG. 6, the multi directional swiveling outlet adaptor 100 constructed in accordance with a preferred embodiment of the invention essentially folds flat against the surface of the outlet 400 such that the thickness of adaptor 100 is essentially the width of a plug, which is the smallest dimension that the adaptor can have without using specialized plugs. In contrast, prior art adaptor 300 has a broader dimension and does not have as small a profile as does the multi directional swiveling outlet adaptor 100 in accordance with the invention.

In current preferred embodiments of the invention, the multi directional swiveling outlet adaptor 100 is constructed of resins or plastics in accordance with current industry norms and conventional materials. Different materials may be utilized depending upon specific applications. Generally, the windows 104 on opposing surfaces of main body 101 are formed of a generally transparent or translucent plastic material which allows the light from light-emitting diode 120 to illuminate them in a fashion which is readily observable. The electrical connections within adaptor 100 are generally conventional in nature. Similarly, the fashion in which plug assembly 102 rotates relative to main block 101 utilizing rounded section 108 of plug 102 and side walls 109 of main section 101 is generally conventional. Obviously, the electrical connection is made so that there is a continuous connection between plugs 103 and adaptors 105, 106 and 107, regardless of the relative rotation of plug section 102 to main section 101. The rotation and configuration of plug section 102 is such that it rotates so that it is 90 degrees from the primary plane of the main body 101 to minimize the profile of the adaptor 100 when it is used up against a wall, as when furniture rests against the wall. An example of this is where wall outlets exist behind a bed or behind a furniture dresser. With adaptor 100, any adaptor can be plugged into the outlet and then rotated in a fashion such that three additional powered devices can be connected to the adaptor without moving the furniture or requiring that the space be of more than a plug width from the wall.

The swivel three-outlet adaptor has the ability to swivel at 180 degrees from a vertical orientation in which the middle outlet is vertical to another vertical orientation where the middle outlet points downward and each point continuously in the arc between these two positions. The three-outlets, as can be seen in FIG. 1, are oriented at a generally 90 degree angle to each other so that the widest possible separation of distance and angle is provided between the three connectors. This is particularly relevant where the outlet adaptor is utilized behind a piece of furniture where it is important that the adaptor itself and the power cords not make connection of the power cords difficult as a result of the orientation. By virtue of the wires coming out at three directions, the wires coming out can also be maintained in a more tangle free fashion. In addition, because of the swivel feature to the outlet adaptor, two units can be placed in a duplex wall socket without difficulty. In addition, because of the way in which the outlets extend in different directions, where an electrical device has a brick-like connector, which is substantially larger than the plug itself, this will not interfere with the ability to connect other electrical devices to the swivel outlet adaptor. In a current preferred embodiment the adaptor 100 has a low profile of about only one inch when it is swivelled as shown in FIG. 6. This is not true in connection with the prior art swivel tab shown in FIG. 7 in which the three outlets are in a line. In this case, the big brick-like adaptor would likely cover more than just the one outlet, thereby reducing the utility of the prior art outlet adaptor.

In accordance with the construction of the device the swivel outlet adaptor, which has a contact maintained throughout the range of swiveling, allows the adaptor to have an extremely small profile against the outlet. Essentially, the swivel outlet adaptor is, at its thickest points, only as wide as the largest dimension of a standard plug. While the swivel outlet adaptor is shown with a two pin connection in FIG. 1, U.S. electrical connectors of different shapes or configurations of two, three or even four pin connections can be incorporated with the noted structure.

Finally, the light feature which is implemented utilizing a light emitting diode or other low power lighting device provides a light on both sides of the structure of the swivel outlet adaptor so that the power indication is available whether the swivel adaptor is rotated upwardly or downwardly.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A swivel outlet adaptor comprising:

a plug assembly for connecting to a power source;

a multiple outlet module rotatably coupled to the plug assembly so that an electrical connection is maintained as the plug assembly rotates relative to the outlet module; and a light means coupled to the outlet module for providing a visual indication that the plug is connected to a power source;

the multiple outlet module has two principal surfaces generally parallel to each other and the light means is visible from each of these two principal surfaces and includes three outlet adaptors, each of which is generally perpendicular to both of the principal surfaces of the multiple outlet module and each of the three outlets are spaced at least 90 degrees apart from each other.

2. The adaptor of claim 1 wherein the plug assembly includes a plug which rotates through a range of motion of about 180 degrees from a first position forming a 90 degree angle with the first principal surface of the multiple outlet module to a second position, forming a 90 degree angle with the second principal surface of the multiple outlet module.

3. The adaptor of claim 1 wherein the light means includes a light-emitting diode contained within the multiple outlet module and two windows on surfaces of the multiple outlet module whereby the light from the light-emitting diode can be seen through the windows when the adaptor is connected to a power source.

4. The adaptor of claim 3 wherein one of the windows is placed in each of the principal surfaces of the multiple outlet module.

5. The adaptor of claim 4 wherein the light-emitting diode is connected to circuitry of the adaptor so as to receive a small amount of current.

6. The adaptor of claim 3 wherein the light-emitting diode illuminates the windows from within the multiple outlet module so that a visual indication can be seen from either of the two principal surfaces of the multiple outlet module.

* * * * *